US007488168B2

(12) United States Patent
Hohl, III et al.

(10) Patent No.: US 7,488,168 B2
(45) Date of Patent: Feb. 10, 2009

(54) APPARATUS FOR FABRICATING A WIRE REINFORCED CONCRETE CYLINDER

(75) Inventors: Herbert L. Hohl, III, Ogden, UT (US); Allen J. Reed, Levittown, PA (US)

(73) Assignee: Oldcastle Precast, Inc., Rehoboth, MA (US)

( * ) Notice: Subject to any disclaimer, the term of this patent is extended or adjusted under 35 U.S.C. 154(b) by 902 days.

(21) Appl. No.: 10/851,464

(22) Filed: May 21, 2004

(65) Prior Publication Data

US 2005/0258558 A1 Nov. 24, 2005

(51) Int. Cl.
*E04B 1/16* (2006.01)

(52) U.S. Cl. ..... 425/262; 425/125; 425/117; 425/427; 425/447

(58) Field of Classification Search ..... 425/125, 425/126.1, 262, 427, 447, 117; 264/35; 249/91
See application file for complete search history.

(56) References Cited

U.S. PATENT DOCUMENTS 3,262,175 A * 7/1966 Gourlie et al. ..... 425/117
5,236,322 A * 8/1993 Willert ..... 425/117

* cited by examiner

*Primary Examiner*—Robert B Davis
(74) *Attorney, Agent, or Firm*—Sheridan Ross PC

(57) ABSTRACT

The present invention relates to a method and apparatus for fabricating a reinforced concrete cylinder, and more specifically to a method for centering a reinforcing frame within a form used during the placement of a concrete slurry. One embodiment of the present invention includes a plurality of centering arms that are adapted for selective engagement with the reinforcing frame, thus maintaining it in the predetermined radial location during the fabrication process.

15 Claims, 2 Drawing Sheets

APPARATUS FOR FABRICATING A WIRE REINFORCED CONCRETE CYLINDER

FIELD OF THE INVENTION

The present invention is related to a device and method for fabricating a concrete cylinder and a more specifically a device used to ensure that a reinforcing frame of the concrete cylinder remains at a predetermined radial location during the fabrication process.

BACKGROUND OF THE INVENTION

Concrete pipes are employed in various civil engineering and architectural applications, such as culverts and building support structures, because of their high strength to weight ratio. Generally, concrete pipes are constructed by placing a reinforcing metal frame inside a mold or framework which is adapted to receive and cure concrete. The resultant concrete pipe generally includes a first end, a second end, an outside surface, an inside surface, and a reinforcing frame positioned therebetween that extends along a longitudinal axis between the first end and the second end.

One drawback of the construction of concrete pipes is that the placement of the metal frame relative to the outside and inside surfaces of the pipe may be altered as a result of the forming process. More specifically, it is desirable to maintain the radial location of the metal frame with respect to the internal diameter and outer diameter of the finished concrete pipe, wherein the theoretical structural behavior of the finished product is well characterized. If, for example, the metal frame is offset in the form during fabrication the pipe will have varying material properties, which may lead to localized cracking or frame buckling.

Thus, there is a long felt need in the field of concrete pipe fabrication to ensure that the reinforcing material used therein is located in the proper predetermined location subsequent to the forming operation, thus increasing the probability that the finished product behaves as theoretically expected. The following disclosure describes a device and method for selectively engaging a reinforcing frame to maintain its radial location within the concrete form during pipe fabrication.

SUMMARY OF THE INVENTION

It is thus one aspect of the present invention to provide an apparatus and method for centering a concrete pipe reinforcing frame during pipe fabrication. More specifically, one embodiment of the present invention includes a slotted flange that is operably interconnected to a dispensing shaft used in a traditional concrete pipe forming apparatus. In addition, the slotted flange is operably interconnected to a crank arm that is interconnected to a shaft. When the slotted flange is rotated the shaft rotates about an axis, thus swinging a centering arm radially outward such that it engages the inner diameter of the reinforcing frame. One embodiment of the present invention includes at least three centering arms that selectively engage the reinforcing frame used in the fabrication of concrete pipe to center the frame. The shaft is also operably interconnected to bearings that are mounted in pillow blocks that are interconnected to collars on the dispensing shaft. The centering arms are deployed while the dispensing shaft is slowly pulled out of the pipe forming mold during the forming process, thus maintaining the frame at its predetermined location which is preferably centered between an inner surface and outer surface of the cylinder.

It is another aspect of the present invention to provide an apparatus that is integrated into commonly used concrete pipe forming apparatus. More specifically, one embodiment of the present invention is added to concrete pipe forming apparatus that are currently in use, thus reducing costs to the manufacturer. A traditional apparatus is retrofitted initially by adding a split bearing to the dispensing shaft. The split bearing is generally a plate that provides a bearing surface for contact with the slotted flange. Then, the shaft mechanism, which includes the crankarm and the centering arm, is interconnected to a plurality of bearings that are mounted in pillow blocks that are interconnected via the dispensing shaft. Thus, very few alterations to traditional hardware are required to perform the present invention, which provides significant cost savings.

It is still yet another aspect of the present invention to provide a device that is constructed from common parts and materials, thus reducing manufacturing costs. For example, one embodiment of the present invention uses shafts and bearings made out of steel, or aluminum. The slotted flange and the split bearing are also constructed of steel or aluminum. Further, the collars used and described herein that interconnect to the dispensing shaft are commonly known in the art. Finally, the pillow blocks and bearings, as described herein, are known in the art and are employed in many rotating shaft operations.

Thus, it is one aspect of the present invention to provide a method for fabricating a reinforced concrete pipe, comprising the steps of:

providing a shaped form having an exterior dimension, an interior dimension, an upper end and a lower end;

positioning a reinforcing frame within said form, wherein said reinforcing frame has an exterior dimension and an interior dimension, and which extends substantially between said upper end and said lower end of said shaped form;

inserting a dispensing shaft into said lower end of said shaped form, said dispensing shaft having an upper end and a lower end and being capable of dispensing a concrete slurry into said shaped form;

providing a head interconnected adjacent to said lower end of said dispensing shaft, said head having an external dimension less than said internal dimension of said reinforcing frame, and which defines an internal dimension of said reinforced concrete pipe;

providing a plurality of centering arms operably interconnected to said dispensing shaft, said centering arms capable of reciprocating between a first retracted position and a second extended position, wherein in said extended position said centering arms define a dimension substantially equal to said internal dimension of said reinforcing frame;

reciprocating said centering arms to said second extended position, wherein said centering arms engage and thus center said reinforcing frame within said form;

pumping a predetermined volume of a concrete slurry through said dispensing shaft and into said form, wherein said concrete slurry covers said frame and extends against said form;

moving said head from said lower end to said upper end of said shaped form at a predetermined speed while retaining said centering arms in said second extended position;

withdrawing said head from said upper end of said shaped form;

allowing said concrete slurry to harden; and removing said reinforced concrete pipe from said shaped form.**

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these embodiments.

Figure 1:
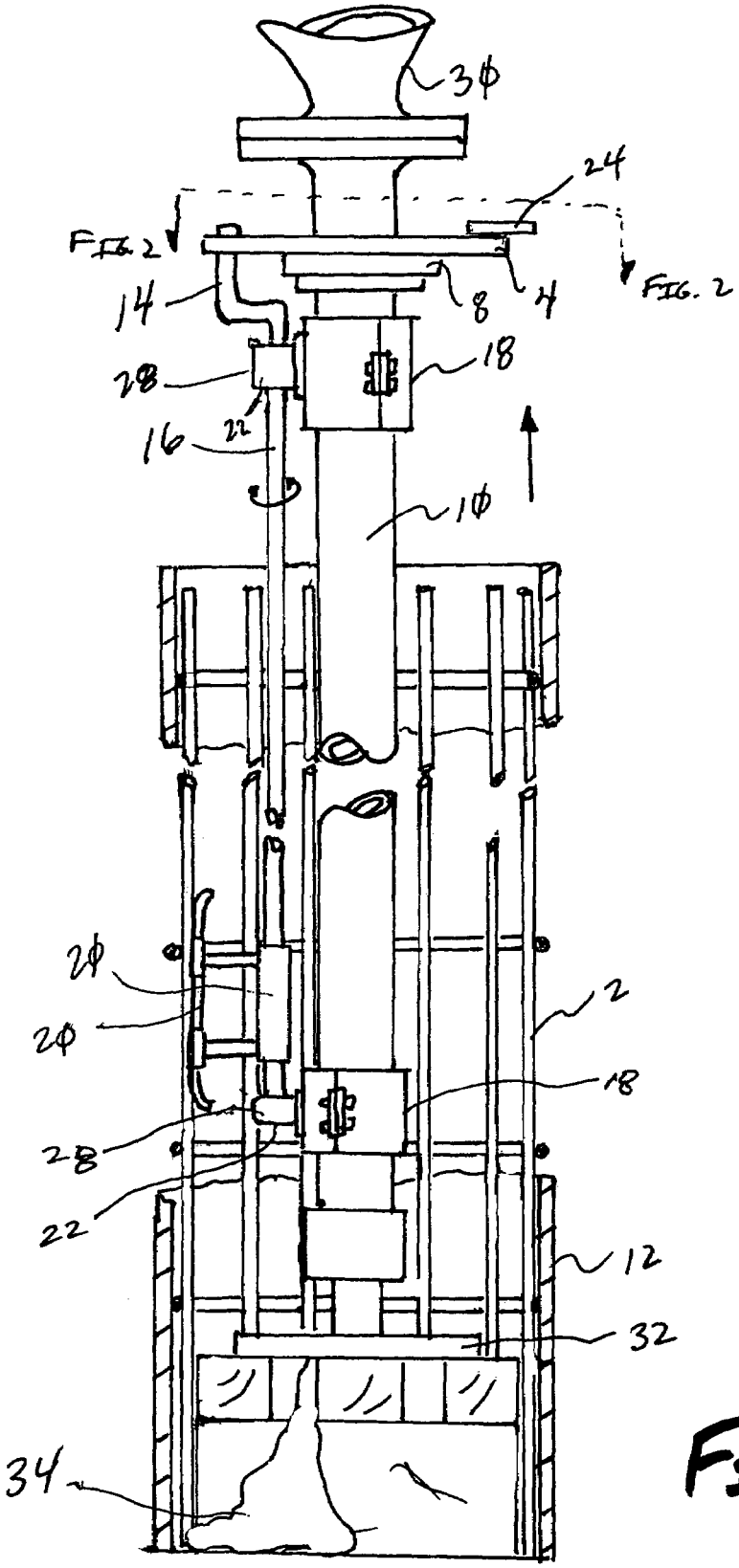
FIG. 1 is a partial front sectional view of one embodiment of the present invention showing a single centering arm for clarity.

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

To assist in the understanding of the present invention the following list of components and associated numbering found in the drawings is provided herein:

| Component | # |
|---|---|
| Reinforcing frame | 2 |
| Slotted flange | 4 |
| Cam bearings | 6 |
| Split bearing | 8 |
| Dispensing shaft | 10 |
| Form | 12 |
| Crank arm | 14 |
| Shaft | 16 |
| Collar | 18 |
| Centering arm | 20 |
| Bearing | 22 |
| Torsion arm | 24 |
| Centering arm collar | 26 |
| Pillow block | 28 |
| Hopper | 30 |
| Dispensing head | 32 |
| Concrete slurry | 34 |
| Rod end | 36 |
| Rod | 38 |

DETAILED DESCRIPTION

Figure 2:
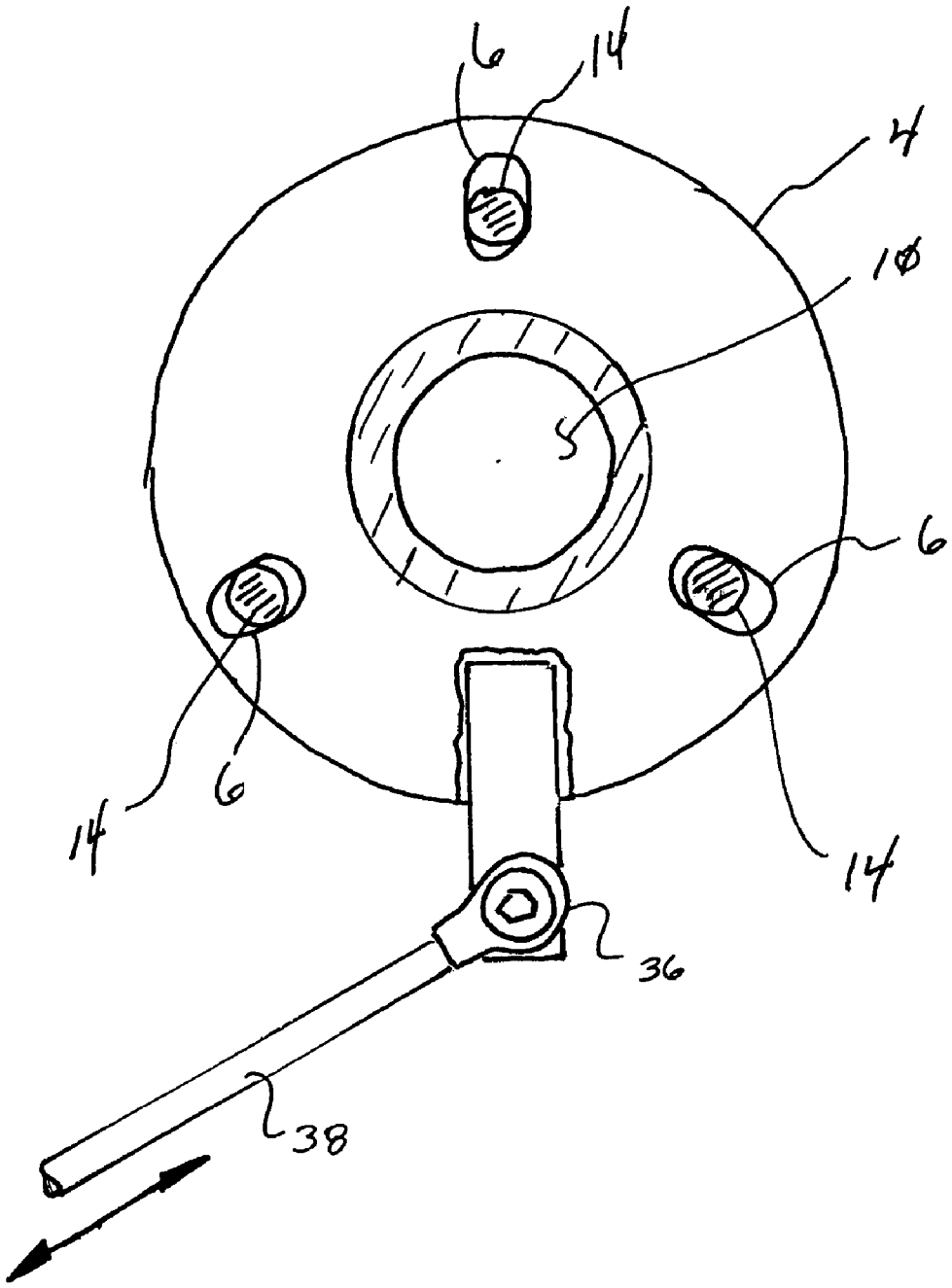
FIG. 2 is a sectional view of a slotted flange that is used to deploy the centering arm of the embodiment of the invention shown in FIG. 1.

Referring now to FIGS. 1 and 2, one embodiment of the present invention that is adapted for selective engagement to a reinforcing frame 2 of a concrete pipe is shown herein. One embodiment of the present invention includes a slotted flange 4 with a plurality of cam bearings 6 that are operably interconnected to a split bearing 8. The split bearing is interconnected to a dispensing shaft 10 that feeds concrete into a concrete form 12. The split bearing 8 is rigidly interconnected to the non-rotating dispensing shaft 10, thus providing a bearing surface that allows the slotted flange 4 to rotate when it is acted upon by an external force. Upon introduction of the external force on the slotted flange 4, crank arms 14, which are operably interconnected to the cam bearings 6 in the slotted flange 4, rotate a shaft 16. The shaft 16, which is interconnected to the dispensing shaft with a plurality of collars 18, deploy at least one centering arm 20. More specifically, upon rotation of the crank arm 14, the shaft 16 rotates, thus deploying the centering arms 20 against the reinforcing frame 2, which was operatively positioned within the concrete form or mold prior to the introduction of a concrete slurry 34. Once engaged, the plurality of centering arms 20 center, and prevent the reinforcing frame 2 from becoming offset in the mold. In addition, the centering arms 20 are adapted to continuously engage the inner diameter of the reinforcing frame 2 when the dispensing shaft 10 is slowly extracted from the form 12 during concrete pipe fabrication, thus assuring the correct positioning of the reinforcing frame while the concrete is placed.

Referring now to FIG. 1, one embodiment of the present invention that is adapted to selectively engage the reinforcing frame 2 of a concrete pipe during fabrication is shown herein. Preferably, the slotted flange 4 of one embodiment of the present invention is operably interconnected to the split bearing 8. Further, the slotted flange 4 includes a plurality of slots, or cam bearings 6, that are operably interconnected to a plurality of crank arms 14 that define the ends of a plurality of shafts 16. The shafts 16 are interconnected to centering arms 20 that travel outwardly to engage the frame 2 upon rotation of the shaft 16. Generally, when an outside force is applied to the slotted flange 4, the crank arms 14 travel within the cam bearings 6 to rotate the shaft 16, thereby swinging the centering arms 20 outwardly to engage the reenforcing frame 2. The shaft 16 of this embodiment of the present invention is supported by a plurality of bearings 22, which in one embodiment of the present invention are steel bushings with bronze inserts. The bearings 22 of the present invention are preferably mounted in pillow blocks 26 that are interconnected to the dispensing shaft 10 by collars 18. Alternatively, the pillow blocks 26 may be interconnected directly to the shaft, however, more alterations to existing hardware may be required as appreciated by one skilled in the art.

Referring now to FIG. 2, a sectional view of the present invention is shown herein. More specifically, the slotted flange 4 of one embodiment of the present invention is shown which includes a plurality of cam bearings 6. The cam bearings 6 are sized to receive a plurality of crank arms 4 such that rotation of the slotted flange will force the crank arms to cycle, thus rotating the shafts. Further, as shown herein, one embodiment of the present invention utilizes three cam bearings 6, which are spaced approximately 120° apart. However, one skilled in the art will appreciate that any number or orientation of cam bearings 6 may be employed without departing from the scope of this invention. In addition, the slotted flange 4 is interconnected to a torsion arm 24 that provides a location for interconnection to a hydraulic cylinder that provides the required force to rotate the slotted flange 4.

Referring again to FIGS. 1 and 2, an apparatus and method of making one embodiment of the present invention is shown and described herein. More specifically, the split bearing 8 is interconnected to the dispensing shaft 10 of a concrete pipe forming apparatus. The split bearing 8 is, in one embodiment of the present invention, a circular plate. The upper surface of the split bearing 8 is adapted to receive the slotted flange 4, and thus allow for rotation thereof. In order to reduce the required force to rotate the slotted flange 4, various lubricants known in the art may also be employed between the split bearing 8 and the slotted flange 4. Preferably, a centering arm collar 26 is interconnected to the shaft 16. The centering arm collar 26 is also interconnected to a plurality of extension rods that interconnect to the centering arm 20. Alternatively, the extension rods, or other offsetting means, may be interconnected directly to the shaft 10 without departing from the scope of this invention. The extension rods ensure that the reinforcing frame is engaged and centered in the form when the centering arms 20 are deployed. In addition, the bearings 22, which are preferably mounted in pillow blocks 28, are added to the shaft 16 at predetermined locations. Finally, the crank arm 14 of the shaft 16 is operatively interconnected the cam bearings 6 of a slotted flange 4, and the pillow blocks 28 are interconnected to the collars 18 on the dispensing shaft to provide a mechanism that swings out to engage the inner diameter of the reinforcing frame 2 during use.

To fabricate a concrete pipe with the properly oriented reinforcing frame 2, initially the reinforcing frame 2 is placed inside the concrete form 12. Next, the dispensing shaft 10 is inserted into the concrete form 12 inside the reinforcing frame 2 with the centering arms 20 in their non-deployed and retracted position. Next, concrete from a hopper 30 is selectively fed through the dispensing shaft 10 and out of the dispensing head 32 into the form 12. This high viscosity concrete slurry 34 is of a low moisture content, or high slump, wherein it hardens fairly quickly. A force is then applied to the torsion arm 24, thus rotating the slotted flange 4, wherein the crank arms 14 rotate the shaft 16 and swing the centering arms 20 into place. The centering arms 20 engage the inner diameter of the reinforcing frame 2, thus ensuring that it remains substantially fixed during the placement of the remainder of the concrete slurry 34. The dispensing shaft 10 is then slowly removed from the form 12 while additional concrete 34 is dispensed through the dispensing head 32, thereby creating the pipe once the concrete cures. In one embodiment of the present invention, the centering arms 20 are constructed of one inch diameter pipe or solid rods that include curled ends to facilitate movement of the centering arm with respect to the reinforcing frame 2. More specifically, the curled ends of the centering arms 20 are oriented to prevent interference with the reinforcing frame 2. Once the centering arm 20 clears the top portion of the concrete form 12, the force on the torsion arm 24 is reversed, thus rotating the slotted flange 4 in the opposite direction to fold the centering arms 20 back to their original position. Finally, the dispensing shaft 10 is removed from the concrete form 12, thus forming a concrete pipe with an outside diameter and an inside diameter, defined from the inside diameter of the form 12 and the outside diameter of the dispensing head 32, respectively. The centering arms 20 ensure that the reinforcing frame 2 remains in its predetermined radial location during the retraction of the dispensing shaft 10.

While various embodiment of the present invention have been described in detail, it is apparent that modifications and adaptations of those embodiments will occur to those skilled in the art. However, it is to be expressly understood that such modifications and adaptations are within the scope and spirit of the present invention, as set forth in the following claims.

What is claimed is:

1. An apparatus for centering a reinforcing frame within a form for fabrication of a concrete pipe, and which is adapted to operably interconnect to a concrete dispensing shaft, comprising:

a slotted flange operably interconnected to the dispensing shaft, said slotted flange comprising a plurality of cam bearings;

a plurality of shafts with a first end and a second end, wherein said first end includes a crank arm for operable interconnection to said cam bearings of said slotted flange;

a plurality of bearings operably interconnected to said shaft and interconnected to said dispensing shaft that allow said shaft to freely rotate;

a plurality of centering arms interconnected to said shaft, said centering arms capable of reciprocating between a first retracted position and a second extended position, wherein in said second extended position said centering arms define a dimension substantially equal to the internal dimension of the reinforcing frame; and wherein rotation of said slotted flange displaces said crank arms thus rotating said shaft and deploying said centering arms from said first retracted position to said second extended position.

2. The apparatus of claim 1, wherein said bearings are mounted in pillow blocks that are interconnected to the dispensing shaft.

3. The apparatus of claim 1, wherein said centering arms are substantially cylindrical members with a first end and a second end, said first end and said second end curled inwardly to substantially prevent interference with the reinforcing frame during fabrication.

4. The apparatus of claim 1, wherein said shaft is substantially cylindrical with an outer diameter of about one inch.

5. The apparatus of claim 1, wherein said bearings are steel bushings with bronze inserts.

6. An apparatus for centering a reinforcing frame within a form for fabrication of a concrete pipe that is adapted for interconnection to an existing concrete dispensing shaft, comprising:

a rotation means operably interconnected to the concrete dispensing shaft;

a shaft operably interconnected to said rotation means;

a frame engagement means interconnected to said shaft, wherein said frame engagement means is capable of a first retracted position and a second extended position; and wherein rotation of said rotation means rotates said shaft wherein said frame engagement means travels from said first position to said second position and operably engages reinforcing frame positioned within the form.

7. The apparatus of claim 6, wherein said rotation means is a slotted flange operably interconnected to the dispensing shaft which also includes a plurality of cam bearings that are operably interconnected to said shaft.

8. The apparatus of claim 6, further comprising a forcing means operably interconnected to said rotation means, wherein activation of said forcing means rotates said rotation means.

9. The apparatus of claim 6, wherein said frame engagement means is a rod positioned substantially parallel to the dispensing shaft, and which is interconnected to said shaft by at least one extension rod.

10. The apparatus of claim 6, wherein said shaft further comprises at least one crank arm for operable interconnection to said rotation means.

11. The apparatus of claim 6, wherein said shaft is constructed from about 1 inch diameter metal rod.

12. The apparatus of claim 6, wherein said shaft is operably interconnected to the dispensing shaft by at least one bearing.

13. The apparatus of claim 6, further comprising a split bearing interconnected to the concrete dispensing shaft that operably interconnects to said rotational means.

14. The apparatus of claim 8, wherein said forcing means is a pneumatic cylinder, a hydraulic cylinder, or a servo mechanical motor.

15. The apparatus of claim 9, wherein said rod has a first end and a second end that are curled inwardly to substantially prevent interference with the reinforcing frame during fabrication.

* * * * *